US008390478B2

(12) United States Patent
Qin et al.

(10) Patent No.: US 8,390,478 B2
(45) Date of Patent: Mar. 5, 2013

(54) WIRELESS EARTH MAGNETIC INDUCTION DETECTION SYSTEM FOR VEHICLE AND ITS INSTALLATION METHOD

(75) Inventors: Zhong Qin, Shanghai (CN); Keyi Wang, Shanghai (CN); Shengyang Wang, Shanghai (CN); Rushan Pan, Shanghai (CN)

(73) Assignee: Shanghai Super Electronics Technology Co. Ltd, Shanghai (CN)

( * ) Notice: Subject to any disclaimer, the term of this patent is extended or adjusted under 35 U.S.C. 154(b) by 477 days.

(21) Appl. No.: 12/731,384

(22) Filed: Mar. 25, 2010

(65) Prior Publication Data

US 2011/0193723 A1 Aug. 11, 2011

(30) Foreign Application Priority Data

Feb. 9, 2010 (CN) ..... 2010 1 0107723

(51) Int. Cl.
*G08G 1/01* (2006.01)
*G08G 1/04* (2006.01)

(52) U.S. Cl. ..... 340/942; 340/941; 340/936

(58) Field of Classification Search ..... 340/941, 340/942, 936
See application file for complete search history.

(56) References Cited

U.S. PATENT DOCUMENTS 4,939,512 A * 7/1990 Dennison et al. ..... 340/933
6,373,402 B1 * 4/2002 Mee ..... 340/937
6,574,548 B2 * 6/2003 DeKock et al. ..... 701/117
7,986,339 B2 * 7/2011 Higgins ..... 348/149
2005/0035880 A1 * 2/2005 Roland ..... 340/941
2005/0190077 A1 * 9/2005 Kavaler ..... 340/933
2007/0257818 A1 * 11/2007 Aubrey et al. ..... 340/932.2
2008/0129545 A1 * 6/2008 Johnson et al. ..... 340/933

FOREIGN PATENT DOCUMENTS

WO WO 2009145384 A1 * 12/2009

* cited by examiner

*Primary Examiner* — Daniel Wu
*Assistant Examiner* — Emily C Terrell
(74) *Attorney, Agent, or Firm* — Ming Chow; Sinorica, LLC

(57) ABSTRACT

The present invention providing a system and installation method of wireless vehicle detection based on earth magnetic induction a signal collection module, a signal conditioning module, a MCU control module, a wireless communication module, a battery module and a signal receiver module includes. When the system is installed, firstly, a cylindrical cavity is cut in the road lane along the driveway; secondly, the adhesive is smeared on the interior of the cylindrical cavity; thirdly, a vehicle detection shell is provided, which includes a signal collection module, a signal conditioning module, a MCU control module, a wireless communication module, and a battery module inside; the whole lower part of the vehicle detection shell is inserted into the cylindrical cavity, then the adhesive is filled between the vehicle detection shell and the interior of the cylindrical cavity, which makes the lower portion of the vehicle detection shell firmly cemented in the cylindrical cavity; finally, a signal receiver module and an external processing module is provided, the external processing module is connected to the signal collection module for analyzing and processing the signals received from the signal collection module. The present invention owns many advantages including: the small volume, sensitive detection performance, the fast installation and the easy maintenance.

9 Claims, 2 Drawing Sheets

WIRELESS EARTH MAGNETIC INDUCTION DETECTION SYSTEM FOR VEHICLE AND ITS INSTALLATION METHOD

FIELD OF THE INVENTION

This invention generally refers to a system and an installation method of vehicle detection. And it more specifically refers to a system and an installation method of wireless vehicle detection based on earth magnetic induction.

BACKGROUND OF THE INVENTION

Vehicle detection technology is focusing on detecting and acquiring traffic information about the vehicles on the road, and the main information includes: the traffic volume, the direction, the speed of the vehicles, the location and the type of vehicle. At present, the induction coil is used in the widespread detection method about vehicle detection technology, which is commonly known as a "ground inductance coil". The circular induction coil is embedded in the subsurface of the roads, and the circular induction coil generates a magnetic field when it is energized. While there is a vehicle passing, which cutting through the magnetic field generated by the circular induction coil, so that causing the changes in electromagnetic induction and then implementing the detection of the presence of the vehicles.

The China Patent by Gu (CN 2258299Y) discloses a vehicle detection device, including an outer annular coil which is shallowly buried under the road surface and served as a sensor coil, a vehicle detection device body, a vehicle detection circuit, as well as transmission cables which connecting the vehicle detection circuit and outer annular coil. An oscillator, which is connected to the outer annular coil, wherein one of its output terminals is connected to a voltage comparator and another terminal is connected to a first driver. The voltage comparator transfer the oscillator signal into the pulse signal, and oscillation frequency is calculated by the trigger, the counter and the micro computer. This patent provides corresponding anti-interference means against various environment interferences to avoid the dead lock. However, this type of vehicle detection device disadvantaged in:

1. Long construction duration and traffic affect because of blocking the road.
2. Destroying the surface of the road and impact the appearance of the road.
3. The high rate of damage, which is caused by the coil fracture due to the road oscillation.
4. Difficulty in maintenance, including the difficulty in finding the damaged point and long construction duration of the maintenance.

The SHIMIZU's patent (U.S. Pub. No. US2009/0278710A1) discloses a moving vehicle system and method of detecting position of moving vehicle, a detection head has an array including a plurality of coils. Magnetic marks are arranged in a travel route at a pitch equal to the array length. By interaction between the magnetic marks and the coils, a position of a moving vehicle is determined based on the magnetic marks.

The Lohberg's patent (US 2004/0100251A1) discloses active magnetic field sensor, use thereof, method and device, The present invention relates to an active magnetic field sensor, in particular a wheel bearing sensor unit, comprising at least one magnetic sensor element for converting a temporally periodic magnetic field into a temporally periodic electric sensor signal at signal outputs and an electronic signal-evaluating circuit, the said magnetic field sensor being electrically fed by way of a sensor interface, wherein an active electric processing of periodic signals of the magnetic sensor element is performed in two or more separate signal channels of the evaluating circuit respectively associated with the sensor signals. The present invention further discloses a motor vehicle influencing device and a method preventing a vehicle from rolling on an inclined plane.

Therefore, although there are many vehicle detection devices used for detecting traffic situation, such as the above disclosed, the installation of the vehicle detections are still difficult, and the construction duration is long, and it needs to destroy the roads and affecting the surface appearance. Further more, the coil which is used in most vehicle detection devices is easy to be destroyed because of the road vibration, and it is difficult to find where the broken point is, and it costs a long time to repair as well.

SUMMARY OF THE INVENTION

The present invention provides a wireless earth magnetic induction detection system for vehicle and its installation method. The present invention advantages in small in size, sensitive detection performance, easy to be installed and maintained.

In order to achieve the solution of this invention is to provide a wireless earth magnetic induction detection device for vehicle, including a signal collection module, a signal conditioning module, a MCU control module, a wireless communication module, a battery module and a signal receiver module. Wherein the signal collection module is connected to the signal conditioning module and the signal collection module sends signals to the signal conditioning module through the one-way transmission; wherein the signal conditioning module is connected to the MCU control module and the signal conditioning module sends signals to the MCU control module through the one-way transmission; wherein the MCU control module is connected to the wireless communication module and the MCU control module sends signals to the wireless communication module through the one-way transmission; wherein the signal receiver module receives signals from the wireless communication via wireless communications; wherein the battery module is connected to the signal conditioning module and supplying the energy to the signal conditioning.

The system of wireless vehicle detection device further comprises a shell of the vehicle detection device (hereinafter, called "vehicle detection shell"); wherein the signal collection module, the signal conditioning module, the MCU control module, the wireless communication module and the battery module are all located in the shell, while the signal receiver module is located outside of the shell.

In accordance with the further aspects of the system, the wireless communication module comprises an integrated antenna, said integrated antenna is integrated with a signal collection module, a signal conditioning module and a MCU control module in one chip.

In accordance with the further aspects of the system, the frequency of the signal communication is 2.4 G.

In accordance with the additional aspects of the invention, the system further includes an external processing module, wherein the external processing module is connected to the signal collection module for analyzing and dealing with the signals received from the signal collection module.

In accordance with the further aspects of the system, the external processing module is a processing module, which is used for handling information of vehicle position.

In accordance with the further aspects of the system, the external processing module is a traffic control system, which includes a signal control module, a red light signal module, a red-light-running control module and a camera device. The said signal control module is connected to a red light signal module for ensuring the normal operation of the red light signal. The said red light signal module is connected to the red-light-running control module for transmitting the traffic signal information to the red-light-running control module. The said signal collection module is connected to the red-light-running control module for transmitting the vehicle situation signal information to the red-light-running control module. The said red-light-running control module is connected to the camera device for controlling the camera device to take pictures of the vehicle which breaks traffic rules.

In accordance with the further aspects of the system, the upper portion of the vehicle detection shell is flat oval in shape with bulge in its center, the thickness of the upper portion is 1.2 cm, and the diameter range of the upper portion is 9 cm~14 cm. The said lower portion of the vehicle detection shell is cylinder, and the bottom diameter of the lower portion of the vehicle detection shell is less than 4 cm while the height of the lower portion of the vehicle detection shell is less than 6 cm.

In accordance with the further aspects of the invention, the installation method comprising:

Step 1: Cutting a cylindrical cavity in the road surface along the driveway;

Step 2: Smearing the adhesive on the interior of the cylindrical cavity;

Step 3: Providing a vehicle detection shell, in which there is a signal collection module, a signal conditioning module, a MCU control module, a wireless communication module and a battery module; inserting the whole lower part of the vehicle detection shell into the cylindrical cavity, then filling with the adhesive between the vehicle detection shell and interior of the cylindrical cavity, which makes the lower portion of the vehicle detection shell firmly fixed in the cylindrical cavity;

Step 4: Providing a signal receiver module, and the distance between the signal receiver module and the vehicle detection shell is over 40 m;

Step 5: Providing an external processing module, the external processing module is connected to the signal collection module for analyzing and processing the signals received from the signal collection module.

In accordance with the further aspects of the install method, in Step 3, the upper portion of the vehicle detection shell is exposed to the surface of the ground and the edge of the upper portion of the shell closely adjoins the ground.

Based on the above reason, comparing with the existing techniques the present invention owns the following benefits:

1. The present invention can detect traffic information by the effect of the vehicle on the earth magnetic field, then the information is sent wireless sly to the signal collection module, that makes the signal easy to be analyzed and achieve the high measurement precision and the strong environmental adapt ability. Further more, the frequency of the signal communication is 2.4 G which is the free frequency and thus to save the cost.

2. The present invention integrating antenna includes a signal collection module, a signal conditioning module and a MCU control module in one chip, which improves the aggregation and sensitivity.

3. The present invention includes the upper portion of the vehicle detection shell which is exposed to the surface of the ground and the edge of the upper portion of the shell closely adjoins the ground, which makes the vehicle detection shell difficult to be destroyed by the running vehicle on the road.

4. The present invention owns various advantages in the small volume, the fast installation and the easy maintenance.

BRIEF DESCRIPTION OF THE DRAWINGS

The preferred and alternative embodiments of the present invention are described in detail below with reference to the following drawings.

DETAILED DESCRIPTION OF THE PREFERRED EMBODIMENT

Figure 1:
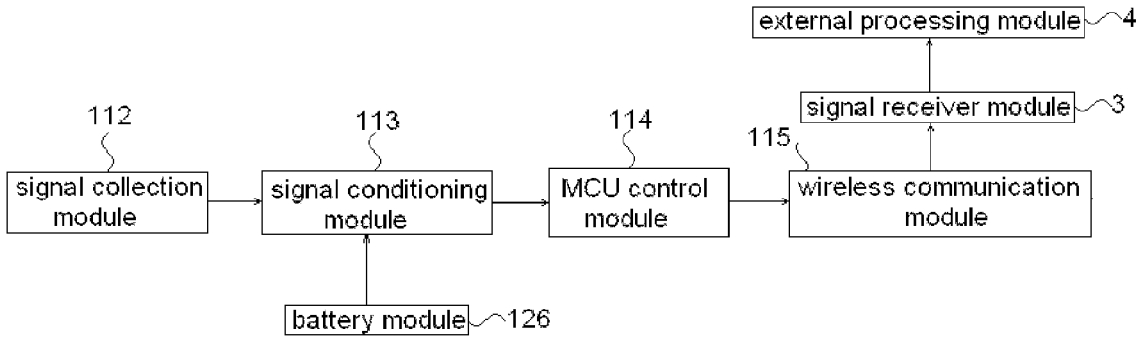
FIG. 1 is a block diagram and showing the system of the present invention wireless vehicle detection.

FIG. 1 is a block diagram showing the system of the present invention about the wireless vehicle detection device. The system includes a signal collection module 112, a signal conditioning module 113, a MCU control module 114, a wireless communication module 115, a battery module 126, a signal receiver module 3 and an external processing module 4; wherein the signal collection module 112 is connected to the signal conditioning module 113 and the signal collection module 112 sends signals to the signal conditioning module 113 through the one-way transmission; wherein the signal conditioning module 113 is connected to the MCU control module 114 and the signal conditioning module 113 sends signals to the MCU control module 114 through the one-way transmission; wherein the MCU control module 114 is connected to the wireless communication module 115 and the MCU control module 114 sends signals to the wireless communication module 115 through the one-way transmission; wherein the signal receiver module 3 receives signals from the wireless communication 115 via wireless communications, the receiving radius of the signal is larger than 40 m and the frequency of the communication is 2.4 G, the external processing module 4 is connected to the signal collection module for analyzing and processing the signals received from the signal collection module; wherein the battery module 126 is connected to the signal conditioning module 113 and for powering the signal conditioning; in the system, the wireless communication module 115 comprises an integrated antenna, said integrated antenna is integrated with the signal collection module 112, the signal conditioning module 113 and the MCU control module 114 in one chip, which improves the integration and sensitivity.

Figure 2:
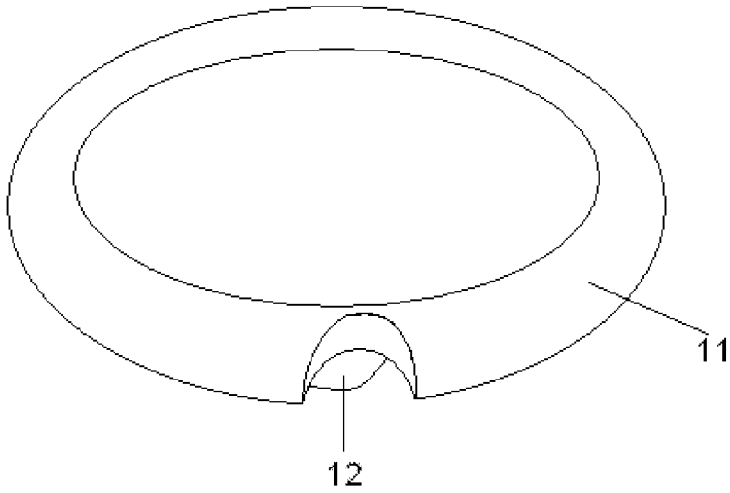
FIG. 2 is a top view of the present invention and showing the vehicle detection shell.
Figure 3:
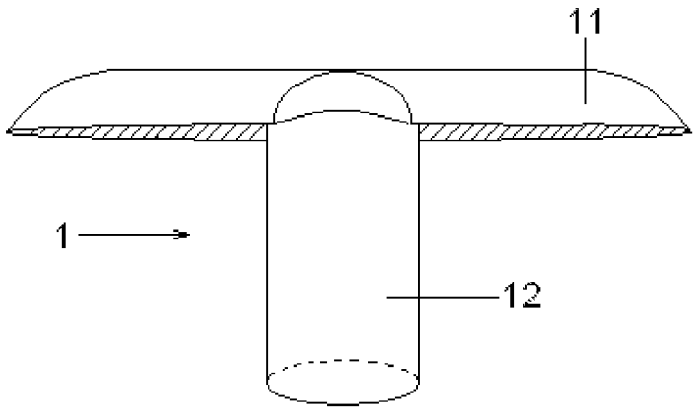
FIG. 3 is a side view of the present invention and showing the vehicle detection shell.

FIG. 2 and FIG. 3 are top and side view of the present invention and showing the vehicle detection shell; the system further comprises a vehicle detection shell 1. The signal collection module 112, the signal conditioning module 113, the MCU control module 114, the wireless communication module 115, the battery module 126 are all located in the vehicle detection shell 1, the signal receiver module 3 is located outside of the vehicle detection shell 1. The vehicle detection shell 1 has an upper portion 11 and a lower portion 12. The upper portion of the vehicle detection shell 11 is flat oval in shape with bulge in its center. The thickness of the upper portion 11 is 1.2 cm, and the diameter range of the upper portion 11 is 9 cm~14 cm. In a preferred embodiment, the diameter range of the upper portion 11 is 12 cm, in another preferred embodiment, the diameter range of the upper portion 11 is 10 cm. The shape of the said lower portion of the vehicle detection shell 12 is like a cylinder. The bottom diameter of the lower portion of the vehicle detection shell 12 is less than 4 cm. In another preferred embodiment, the bottom diameter of the lower portion of the vehicle detection shell 12 is 3.3 cm. The height of the lower portion of the vehicle detection shell 12 is less than 6 cm. In a preferred embodiment, the height of the lower portion of the vehicle detection shell 12 is 5.5 cm.

When the wireless vehicle detection device is installed, firstly, a cylindrical cavity is cut in the road lane along the driveway; secondly, the adhesive is smeared on the interior of the cylindrical cavity; thirdly, a vehicle detection shell is provided, which includes a signal collection module, a signal conditioning module, a MCU control module, a wireless communication module, and a battery module inside, the whole lower part of the vehicle detection shell is inserted into the cylindrical cavity, then filling with the adhesive between the vehicle detection shell and the interior of the cylindrical cavity, therefore it makes the lower portion of the vehicle detection shell firmly fixed in the cylindrical cavity; finally, a signal receiver module and an external processing module are provided, the distance between the signal receiver module and the vehicle detection shell is larger than 40 m; the external processing module is connected to the signal collection module for analyzing and processing the signals received from the signal collection module.

Figure 4:
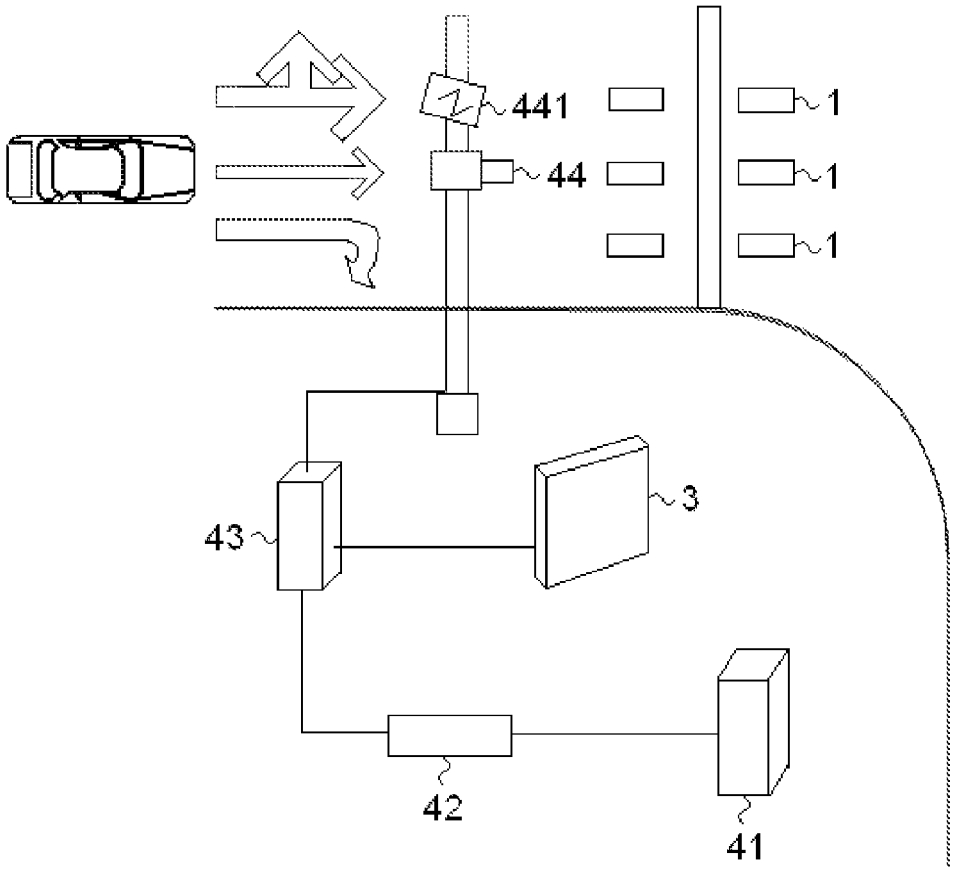
FIG. 4 is a block diagram and showing the system of gathering red-light-runner in accordance with an embodiment of the invention.

The present invention can be used for gathering the red-light-runner, FIG. 4 is a block diagram and showing the system of gathering red light runner in accordance with an embodiment of the invention. The system contains a signal collection module 112, a signal conditioning module 113, a MCU control module 114 and a wireless communication module 115, which are located in the upper portion of the vehicle detection shell 11, a battery module 126 which is located in the lower portion of the vehicle detection shell 12, a signal receiver module 3 and an external processing module 4 which are located outside of the vehicle detection. The external processing module 4 includes a signal control module 41, a red light signal module 42, a red-light-running control module 43 and a camera device 44. The said signal control module 41 is connected to a red light signal module 42 for ensuring the normal operation of the red light signal 42; the said red light signal module 42 is connected to the light control module 43 for transmitting the traffic light signal information to the red-light-running control module 43; the said signal collection module 3 is connected to the red-light-running control module 43 for transmitting the vehicle situation signal information to the red-light-running control module 43, the said red-light-running control module 43 is connected to the camera device 44 for controlling the camera device 44 to take pictures of the vehicle which breaks traffic rules. In the preferred embodiment, the signal control module 41 control the red light signal module 42 under the normal operation situation. While the red light signal module is power on, if the car runs the red light, that would affect the earth magnetic, at the same time, a signal collection module 112 inside the vehicle detection shell 1 would get the signal information, and the system would transmit the information to the external processing module 3 by wireless communication, then the external processing module 3 would transmit the information to the red-light-running control module 43, the red-light-running control module 43 would control the camera device 44 to take pictures of the car which breaks the traffic regulation. In a preferred embodiment, there is a fill light 441 to strengthen the light so as to ensure the excellent condition for photograph.

The present invention can also be used for detecting vehicle information in parking place. In a preferred embodiment, the external processing module is a location processing module. When the signal collection module 112 gets the vehicle information, the signal collection 112 would sent the information to location processing module through a signal conditioning module 113, a MCU control module 114 and a wireless communication module 115. Then the location processing module would register the information. Therefore, the people can know the parking situation conveniently.

In addition, the wireless magnetic vehicle detection device can also be used for the road traffic security-access monitoring system or the vehicles inspection of the entrance and the exit, which assist people in security administration and vehicles management.

While the preferred embodiment of the invention has been illustrated and described as noted above, it shall be acknowledged that various changes can be made without departing from the spirit and scope of the following attached claims. Additionally, it shall be also noticed that the expression, the terms and the cited reference are mainly used for the purpose of the instruction, and which shall not limit the scope of the present invention.

Therefore, the skilled in the art may understand that the points of this invention can be used as the other structure, system and method for the implement of the various purposes of this invention. Accordingly, the most important thing is the attached claims shall be deemed including all the equal structures, only if they depart from the spirit and scope of the invention.

What we claimed:

1. A system of wireless vehicle detection device, comprising:

a signal collection module, a signal conditioning module, a Micro Control Unit MCU control module, a wireless communication module, a battery module and a signal receiver module;

wherein the signal collection module is connected to the signal conditioning module and the signal collection module sends signals to the signal conditioning module through the one-way transmission;

wherein the signal conditioning module is connected to the Micro Control Unit MCU control module and the signal conditioning module sends signals to the Micro Control Unit MCU control module through the one-way transmission;

wherein the Micro Control Unit MCU control module is connected to the wireless communication module and the Micro Control Unit MCU control module sends signals to the wireless communication module through the one-way transmission;

wherein the signal receiver module receives signals from the wireless communication module via wireless communications;

wherein the battery module is connected to the signal conditioning module and for powering the signal conditioning; and the system of the wireless vehicle detection device further comprises a vehicle detection shell, wherein the vehicle detection shell has an upper portion and a lower portion, wherein the upper portion contains the signal collection module, the signal conditioning module, the Micro Control Unit MCU control module, the wireless communication module, and the lower portion contains the battery module, the entire lower portion is inserted into the road, while the signal receiver module is located outside of the vehicle detection shell.

2. The system of claim 1, wherein the wireless communication module comprises an integrated antenna, said integrated antenna is integrated with the signal collection module, a signal conditioning module and a Micro Control Unit control module in one chip.

3. The system of claim 1, wherein the signal communication frequency is 2.4 GHz.

4. The system of claim 1 further comprising an external processing module, wherein the external processing module is connected to the signal receiver module for analyzing and processing the signals received from the signal receiver module.

5. The system of claim 4, wherein the external processing module is a processing module used for processing information of vehicle position.

6. The system of claim 4, wherein the external processing module is a traffic control system, which includes a signal control module, a red light signal module, a red-light-running control module and a camera device, said signal control module is connected to the red light signal module for ensuring the normal operation of the red light signal, the said red light signal module is connected to the light control module for transmitting the traffic signal information to the red-light-running control module; the said signal collection module is connected to the red-light-running control module for transmitting the vehicle signal information to the red-light-running control module, the said red-light-running control module is connected to the camera device for controlling the camera device to take pictures of the vehicle which breaks traffic rules.

7. The system of claim 1, wherein the upper portion of the vehicle detection shell is flat oval in shape with bulge in its center, the thickness of the upper portion is 1.2 cm, the diameter range of the upper portion is 9 cm~14 cm, the said lower portion of the vehicle detection shell is cylindrical, the bottom diameter of the lower portion of the vehicle detection is less than 4 cm and the height of the lower portion of the vehicle detection shell is less than 6 cm.

8. A install method of wireless vehicle detection device, comprising:

Step 1: Cutting a cylindrical cavity in the road surface along the driveway;

Step 2: Smearing the adhesive on the interior of the cylindrical cavity;

Step 3: Providing a vehicle detection shell, the vehicle detection shell has an upper portion and a lower portion, the upper portion contains a signal collection module, a signal conditioning module, a Micro Control Unit MCU control module, a wireless communication module, and the lower portion contains a battery module in the vehicle detection shell; inserting the whole lower part of the vehicle detection shell into the cylindrical cavity, then filling with the adhesive between the vehicle detection shell and interior of the cylindrical cavity, which makes the lower portion of the vehicle detection shell firmly fixed in the cylindrical cavity;

Step 4: Providing a signal receiver module, and the distance between the signal receiver module and the vehicle detection shell is over 40 m;

Step 5: Providing an external processing module, the external processing module is connected to the signal receiver collection module for analyzing and handling signals received from the signal receiver collection module.

9. A install method of claim 8, in Step 3, wherein the upper portion of the vehicle detection shell is exposed to the surface of the ground and the edge of the upper portion of the shell closely adjoins the ground.

* * * * *